US008939317B2

(12) United States Patent
Roeterdink

(10) Patent No.: US 8,939,317 B2
(45) Date of Patent: Jan. 27, 2015

(54) CONTAINER BODY AND ITS METHOD OF MAKING

(75) Inventor: Johan Willem Roeterdink, Epse (NL)

(73) Assignee: Impress Group B.V., Deventer (NL)

( * ) Notice: Subject to any disclaimer, the term of this patent is extended or adjusted under 35 U.S.C. 154(b) by 0 days.

(21) Appl. No.: 14/007,525

(22) PCT Filed: Mar. 29, 2012

(86) PCT No.: PCT/EP2012/055690

§ 371 (c)(1),
(2), (4) Date: Dec. 13, 2013

(87) PCT Pub. No.: WO2012/130980

PCT Pub. Date: Oct. 4, 2012

(65) Prior Publication Data

US 2014/0091002 A1 Apr. 3, 2014

(30) Foreign Application Priority Data

Mar. 31, 2011 (EP) ..... 11160650

(51) Int. Cl.

| | |
|---|---|
| ***B21D 51/26*** | (2006.01) |
| ***B65D 6/38*** | (2006.01) |
| ***B21D 15/06*** | (2006.01) |
| ***B65D 6/34*** | (2006.01) |
| ***B65D 51/24*** | (2006.01) |

(52) U.S. Cl.

CPC ..... *B21D 51/2676* (2013.01); *B21D 15/06* (2013.01); *B21D 51/26* (2013.01); *B65D 7/46* (2013.01); *B65D 7/48* (2013.01); *B65D 51/247* (2013.01)

USPC ..... 220/669; 72/379.4; 72/370.13

(58) Field of Classification Search

CPC ..... B65D 21/086; B65D 21/08; B65D 1/165; B65D 1/16; B21D 51/28; B21D 51/2607; B21D 51/26; B21D 51/2676

USPC ..... 220/666, 669, 670, 660, 689; 206/459.5; 72/379.4, 370.13; 413/1, 413/76, 73, 72, 71; 40/306

See application file for complete search history.

(56) References Cited

U.S. PATENT DOCUMENTS

| | | | | |
|---|---|---|---|---|
| 706,635 | A * | 8/1902 | Booth | 40/306 |
| 3,179,286 | A * | 4/1965 | Morceau | 206/216 |
| 5,137,171 | A | 8/1992 | Goeppner | |
| 2010/0072205 | A1 | 3/2010 | Stuart | |
| 2012/0243963 | A1 * | 9/2012 | Larroche et al. | 413/1 |

FOREIGN PATENT DOCUMENTS

| | | | |
|---|---|---|---|
| DE | 3216660 | A1 | 12/1982 |
| EP | 0108462 | A1 | 5/1984 |
| WO | 2008022933 | A1 | 2/2008 |

* cited by examiner

*Primary Examiner* — Robert J Hicks
(74) *Attorney, Agent, or Firm* — The Webb Law Firm

(57) ABSTRACT

The present invention relates to a method of making a container body (8), comprising the steps of: i) providing a round container body (8); ii) forming at least one circumferential bead (2) in the container body (8); and iii) axially compressing the container body (8) to kink and axially close the kinked bead (10), and to such container body (8) and container comprising same.

15 Claims, 9 Drawing Sheets

CONTAINER BODY AND ITS METHOD OF MAKING

CROSS-REFERENCE TO RELATED APPLICATIONS

This application is the United States national phase of International Application No. PCT/EP2012/055690 filed Mar. 29, 2012, and claims priority to European Patent Application No. 11160650.5 filed Mar. 31, 2011, the disclosures of which are hereby incorporated by reference in their entireties.

BACKGROUND OF THE INVENTION

1. Field of the Invention

The present invention relates to a method of making a container body, to a container body as such, and to a container comprising such container body.

2. Description of Related Art

Metal containers are used for packaging food and non-food, as well as beverages such as pressurized beverages. Such containers may have a diameter in the range of 40-150 mm, such as 96 mm and 127 mm. With an increase of diameter, the thickness of the metal walls is to be increased as well in order to allow for sufficient axial strength and for sufficient resistance to radial compression. Presently there is a high demand for using smaller thicknesses for making containers in order to cut costs for metals used.

Accordingly, the present invention has for its object to provide a container body for a container, which container body will have a sufficiently high axial strength and in particular a high resistance to radial compression although made from thinner metal materials.

SUMMARY OF THE INVENTION

Thereto, the present invention provides a method of making a container body, comprising the steps of:

i) providing a round container body;

ii) forming at least one circumferential bead in the container body; and ii) axially compressing the container body to kink and axially close the kinked bead.

The present invention is based on the insight, that by providing a container body with a circumferential bead, which is thereafter axially compressed such that the kinked and closed bead will impart the container body with an improved resistance to radial compression. If in addition, the bead is folded towards the wall of the container body, will result in an additional improvement of the resistance to radial compression. Such a container may be produced in an elegant manner, because it is essentially sufficient, that after the application of the circumferential bead into the wall of the container body, that axial compression of the container body will result in the desired kinking and bead closure. Preferably the kinked bead is also closed such extent that it appears that in the container wall there is present a small slit, which may be even no longer be accessible because the wall is touching at this slit. If the bead extends outwardly, then the bead is not or substantially not accessible from the interior of the container. When extending inwardly, then there is no or substantially no access from the outside. The properties of such a container body are improved such, that it is possible to produce such a container with these properties using thinner material, such as instead of material having a thickness of 0.22 mm or 0.25 mm. Use can be made of what is called bulk thicknesses for beverage cans, being a material having a thickness of 0.12 mm or 0.14 mm.

It is noted that the effect of the present invention is obtained irrespective the type of container body or container. Accordingly, the container body may have the form of a sleeve of which both ends are to be provided with an end wall, or the container body may have been provided with an end wall at one body end, such as by drawing and ironing or by any other suitable manner like seaming, soldering and the like. In addition, the container body and ultimate container may have a circumferential shape being circular, oval, rounded, angular like square, triangle, or polygonal, and combinations thereof.

The improvement in resistance to radial compression is highest in the middle section of the container body. Accordingly, it is preferred to provide the container body in its middle section with the bead which is subsequently to be kinked and closed. Still, it is possible to provide the bead or other beads in other sections in the container body, such as in a section where a picture or drawing on the outer surface of the container, is to be separated from imprinted wording, such as a manual or advertisement. Otherwise, it is possible to bring intentionally divisional lines in a picture or in a information printing on the outside, thereby attracting the attention of the consumer to specific areas on the container surface. It will be appreciated that by making one or more of these kinked beads in the container wall, the changed appearance will be improving the aesthetic properties of the container, in particular when the ultimate container has a glossy outer surface (coating).

When the bead is formed in the container body and extends outwardly from the container body, then according to an alternative embodiment, the kinked bead may be radially inwardly compressed to an extent that the kinked and compressed part of the container body lies within the hypothetical confinement of the container body so that the outer surface is flush and thus not comprise an outwardly extending structure.

It is noted that the bead is extending circumferentially of the container but it is not necessary that the bead extends over the entire circumference of the container body, so that the container body comprises alternating beaded and original container body surface.

Due to the axial compression, the bead will kink and thereby deform. Kinking will be initiated, when at a particular side of the bead the so called kinking point is surpassed, where after the material will fail and deform by kinking. This means, that when a symmetrical bead is used kinking may start at both sides independently or concomitantly. If it is desired to control the side of of the bead where kinking will occur and thereby the direction in which the deformation of the bead will proceed, it is preferred that when the bead has a symmetrical shape, in step iii) kinking is initiated at one side of the symmetrical bead.

In the alternative, when using an asymmetrical shaped bead, then the direction of kinking and folding of the kinked bead is controlled when preferably the bead has an asymmetrical shape such that the kinking force is different at both bead sides. Kinking will then occur at the side of the bead where the kinking point is first surpassed.

The kinked bead will project from the inside or outside of the container body wall, dependent on whether the bead was initially formed inwardly or outwardly of the container body wall. If it is desired, that the extent of projection length is to be minimized, then it is preferred that the kinked bead is radially compressed. Still, the improvement in resistance to radial compression is maintained.

Generally the circumferentially extending bead may have the form of a horizontally extending straight bead. However, it is also possible that the bead has the form of a serpentine bead which serpentines along the circumference around the container body in a regular (harmonic) or irregular manner. Accordingly, after kinking, the bead will show a wavy (serpentine) line extending around the circumference. In the alternative, the bead may have a wavy form, of which bead width is not constant but changes with the wavy form so that the width of the bead is increasing and decreasing (regularly or irregularly) to nearly a minimal bead width. The minimal bead width, is required such that during the kinking, at those minimal width parts of the bead will be closed or contact in between the bead walls, thereby forming a partially closed bead. However, at locations around the circumference where the width of the bead is larger than the minimal bead width, the bead will not be closed by the kinking and will show over the circumference closed bead parts and open bead parts. This is for many customers an aesthetically beneficial form. Similarly, the bead may have a so-called ornamental form, which means, that over the circumference the bead will have a structure or form which is repeating over the circumference, but in between the bead walls there is a minimal bead width, so that when the bead is kinked and (partially) closed, the result will be an ornamental presentation, such as having the form of a four leave clover. Obviously, many different ornamental type of structures may be possible within the ambit of the present invention. Relevant is, that an open bead is formed with a particular structure, such that after the kinking and (partially) closing of the bead an ornamentally appreciated form is obtained. Instead of a four leave clover form, it is also possible to provide overlapping or adjacent dimples over the circumference, such that after kinking is formed a chain of dimples which may extend inwardly and/or outwardly thereby providing a particular structure that may be sensitized by feeling from the outside. Obviously several types of beads may be present in one and the same container body within the ambit of the present invention.

The inwardly extending kinked bead may also form a support for an insert piece which will be snapped or connected to the inwardly kinked bead. For instance a metering structure may be formed within the interior of the container. Such a metering structure can be used for metering the amount of food, such as baby food to be taken with a spoon from the container comprising a container body according to the present invention, but also stripping paint and the like is possible.

When the container body is also to be radially expanded during the formation of the container, and the kinked bead is projecting inwardly from the container body wall, then it is preferred that the kinked bead is radially compressed during the radial expansion of the container body.

When the outer surface of the ultimate container body is to be provided with printed information, then the aesthetic properties of the container is highly improved if preferably the step of providing printed information on the outside of a perform for the container body, which printed information is separated from a container body section in which the circumferential bead is to be formed. This printed information (or illustration or picture) forming a so called field of information is extending beyond and thus divided by a bead according to the invention, then it is preferred for maintaining the highly aesthetic properties that preferably the printed information present at both sides of the closed and kinked bead is provided in a flushing (non-interrupted) manner.

Another aspect of the invention relates to a container, comprising a container body provided with at least one circumferential axially closed and kinked bead. As indicated before it may be advantageous that the kinked bead is radially compressed and that such compression may take place during the radial expansion of the container body. Similarly, when the container is to be provided with information printed over and separated by a kinked bead according to the invention, it is preferred that such printing has taken place in a so called flushing manner. Accordingly, the reading of the information is not optically separated by the bead.

In this respect it is noted that the kinked and closed bead is such that the slit in between both sides of the closed bead may be minimal or even not present anymore. In the latter situation, because for instance a coating provided on the outside of the container will ultimately close the slit. Accordingly, there is an appearance of the container of a very minor bead although inwardly there is a larger kinked and folded bead that will support the increase of the resistance to radial compression.

BRIEF DESCRIPTION OF THE DRAWINGS

Mentioned and other features of the container body, container and method of making such container body will be further appreciated by a description of several embodiments of the container, of the container body and of the method of making the container, although the description is not intended to limit to any extent the scope of the present invention. In relation to the description reference will be made to drawings, wherein.

DESCRIPTION OF THE INVENTION

Figure 1A:
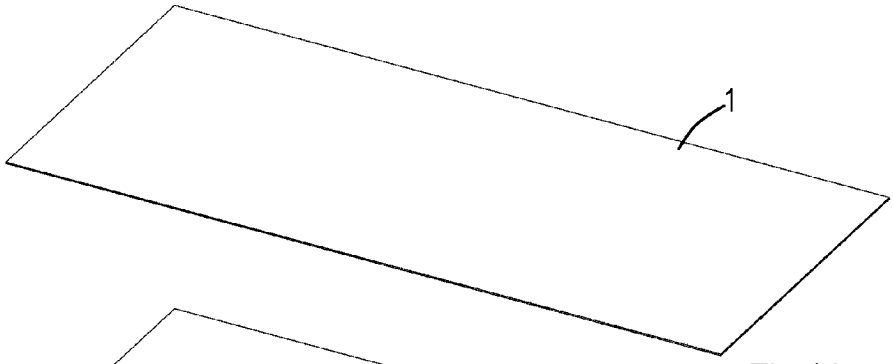
FIGS. 1A-E show various stages of the method of making a container body according to the invention.
Figure 1B:
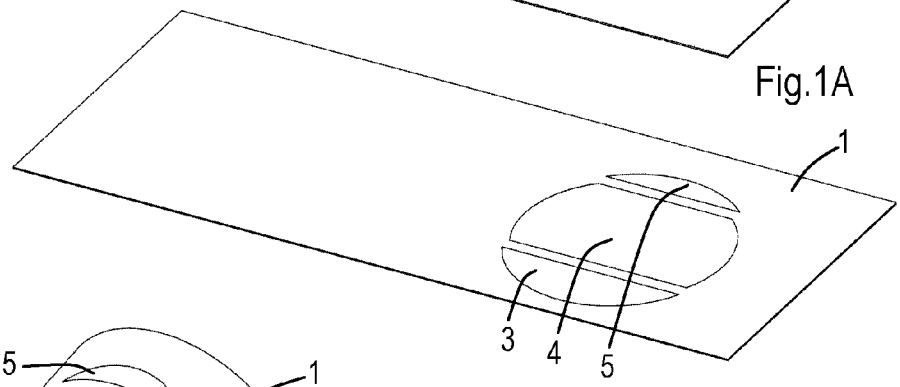
Figure 1C:
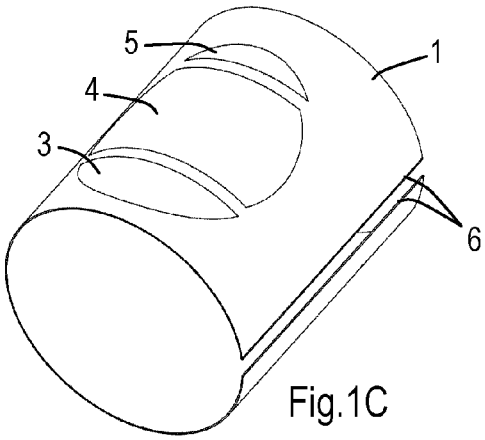
Figure 1D:
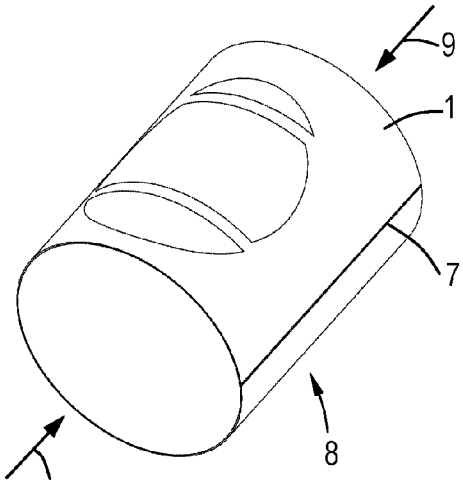

FIG. 1A shows a strip of metal, such as steel, tin plated steel or aluminium. The strip is printed with information fields 3-5 to be separated by the two beads 2 (see FIG. 1D). Subsequently, the strip 1 provided with the information fields 3-5 is formed into a cylindrical shape (FIG. 1C). Thereafter, the edges 6 of the cylindrically formed strip 1 are welded together and provided with a welled line 7.

Figure 1E:
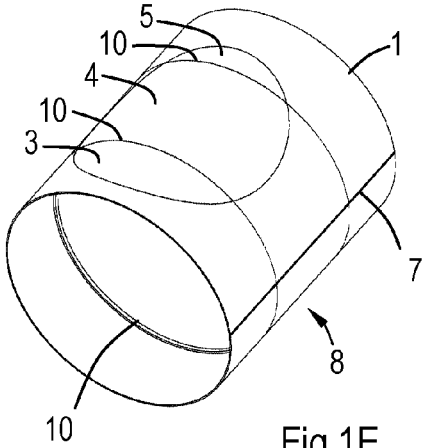

Thereafter, the welded and cylindrically formed container body 8 is provided with two circumferential beads 2 extending in between the information fields 3-5. Finally, the container body is subjected to axial compression following the arrows 9. This results in a kinking and axial closing of the kinked bead, thereby forming a circumferential, axially closed and kinked bead 10. It is shown FIG. 1E, that the closed bead 10 extends over a very minor part of the height of the container body 8, so that the information fields 3-5 are now abutting and almost flushing without any separation. Still, at the inside of the container body 8 the inwardly projecting kinked and folded bead 10 is still appreciable.

As stated above the container body may have been produced by different manners and may have been provided with an end wall in advance, such as before the bead formation and/or the axial compression.

Hereafter the kinking and axial closing and folding of the kinked bead will be further described in detail by way of various embodiments according to the invention.

FIG. 3 shows in cross-section a container body 11 that is provided with two symmetrical beads 12 both extending at about ⅓ from either end of the container body 11.

Figure 3A:
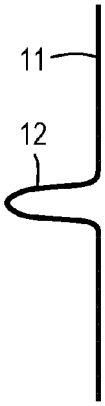
FIGS. 3A-E show various stages of kinking and axially closing a bead present in the container body preform shown in FIG. 2.
Figure 3B:
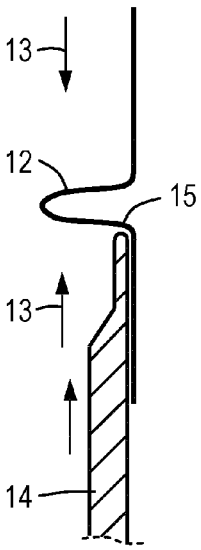
Figure 3C:
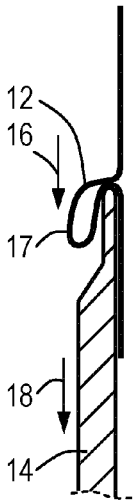
Figure 3D:
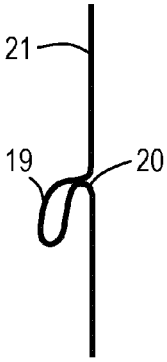
Figure 3E:
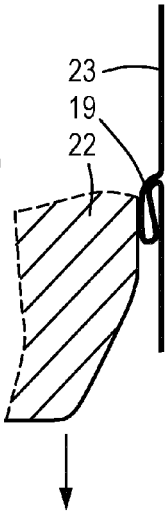

FIG. 3A shows in more detail the symmetrical bead 12. When axially compressing this container body 11 from both ends, the bead 12 may kink and fold towards either end of the container body dependent on whether the so called kinking point is surpassed first at one or the other side of the symmetrical bead 12. In order to control the direction in which the kinking of the bead 12 will occur, it is shown in FIG. 3B, that during axial compression according to the arrows 13, before or at the same time a tool 14 is pressing against the side 15 of the bead 12 thereby surpassing the kinking point at this side 15. This has as a result that the kinking of the bead 12 will take place in the direction of the arrow 16 so that the folded part 17 of the original bead 12 will extend in this case downwardly in that direction from which the tool 14 was approaching side 15 of the bead 12. Retraction of the tool 14 according to the arrow 18 (FIG. 3C) will result in a formed closed and kinked bead 19 as shown in FIG. 3D. The bead 19 is closed because a slit near the location 20 is almost occupied by the material of the container body wall 21. Finally, using a tool 22, the kinked and closed bead 19 is radially compressed thereby reducing to the extent over which the bead 19 extends to the interior of the now formed container body 23. It is noted that the direction of folding the bead may be chosen in relation to the content of the ultimate container, and/or whether the bead may serve as a support, such as a measuring spoon, or closure part (see hereafter).

Figure 4:
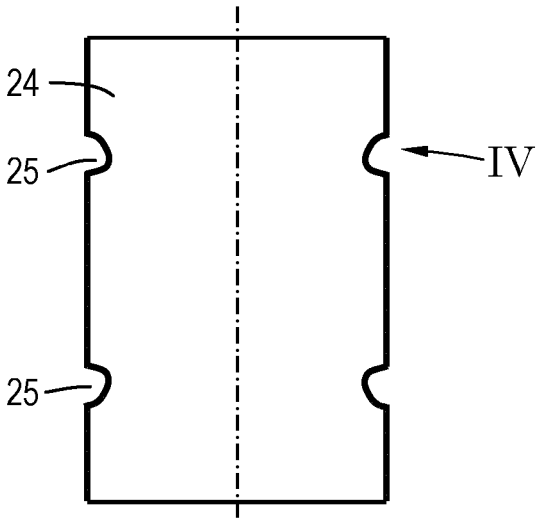
FIG. 4 is a cross-section of another preform for a container body according to the invention.
Figure 6:
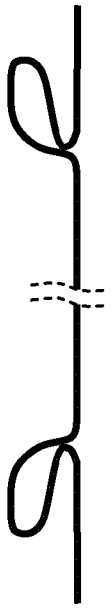
FIG. 6 shows an alternative to the formation of two beads in different directions in the wall of a container body.

FIG. 4 shows in cross-section another preform 24 for a container body according to the invention. In this preform are formed asymmetrical beads 25 extending over the circumference of the perform 24.

Figures 5A, 5B, 5C:
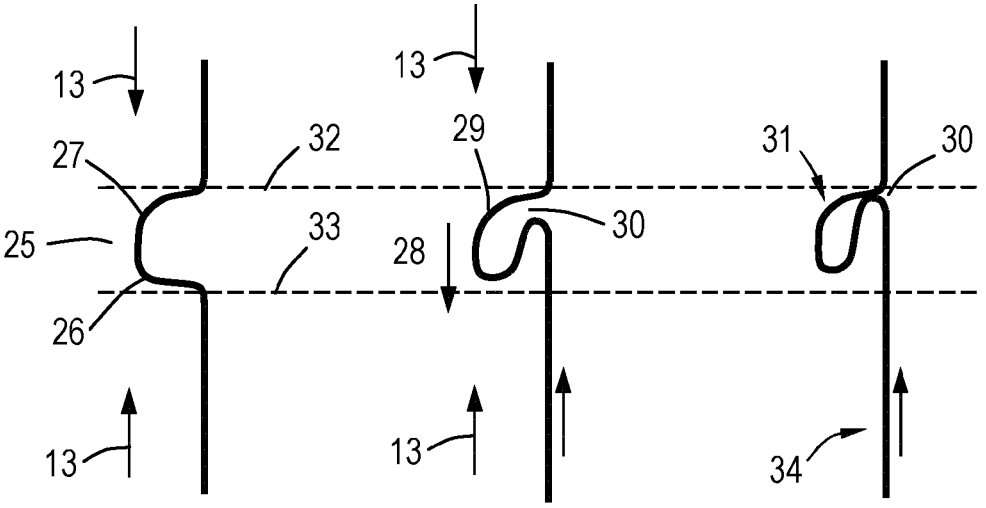
FIGS. 5A-C show various stages of the kinking and closing of the bead formed in the perform for the container body shown in FIG. 4.

As shown in FIG. 5A, bead 25 is asymmetrical which implies in relation to the bead 25 that at the location 26 the radius is smaller, such as 0.7 mm, than at the location 27 where the radius may be 1.25 mm. This means, that upon axial compression according to the arrow 30 the kinking point will be surpassed at a lower axial compression force for the location 26 where the bead 27 will fail or kink first. This results in a folding in the downward direction according to arrow 28 in which direction the part 29 will fold (see FIG. 5B). Continuation of the compression force will result in a closure of a gap 30 thereby forming the kinked and axially closed bead 31 according to the invention. As shown by the level lines 32 and 33, the kinking and closing of the bead 25 will result in a reduction of the height of the original preform 24. Formed is the container body 34 having a similar appearance as the container body 8 shown in FIG. 1E.

Figure 7A:
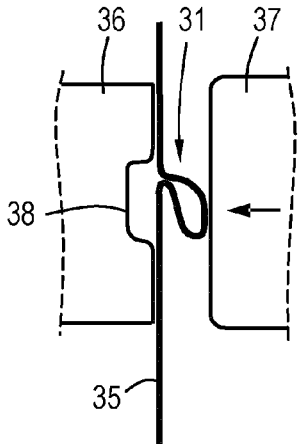
FIGS. 7A-C show the radial compression of a bead shown in FIG. 5C or FIG. 6.
Figure 7B:
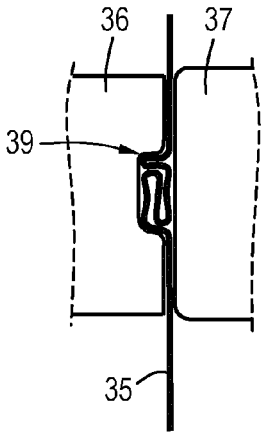
Figure 7C:
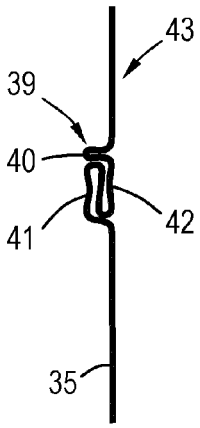

FIGS. 7A-C show a further manipulation of the bead 31 of the invention, as was shown in FIG. 5C, and extending inwardly of the container body 34. In the situation shown in FIGS. 7A-C, the bead 31 extends outwardly of the container body 35. The bead 31 is subjected to a radial compression using tools 36 and 37. The tool 36 is provided with a cavity 38 which is intended to receive and accommodate the bead 31. FIG. 7B shows the end of the radial compression operation with the tools 36 and 37 in closed position, thereby forming a compressed bead 39 substantially filling the cavity 38. The bead 39 comprises a horizontal hairpin 40 and two layered vertical hairpins 41 and 42. Although initially extending outwardly of the container body 35, due to the radial compression with a tool 36 being at the inside of the container body and provided with the cavity 38, the ultimate bead 39 is again extending inwardly of the container body 35 so that its outer surface 43 is substantially not interrupted.

Figure 8A:
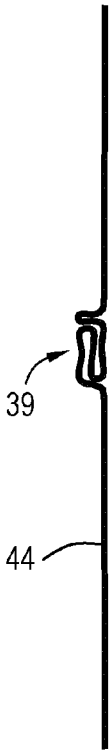
FIGS. 8A-D show the compression of a kink bead by radial expansion of the container wall.
Figure 8B:
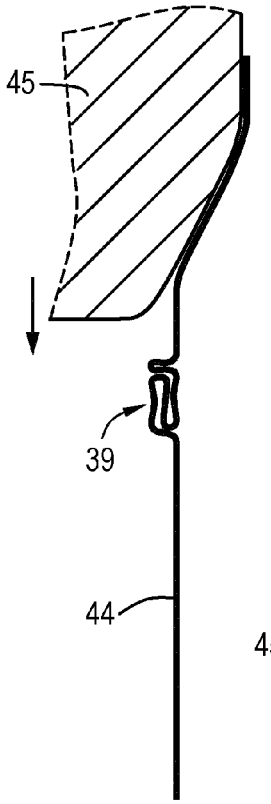
Figure 8C:
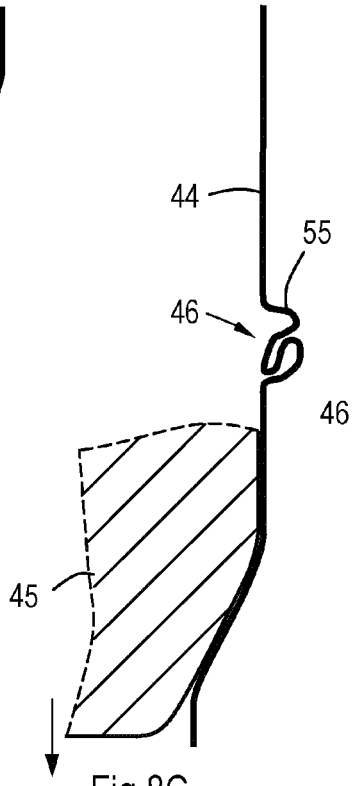
Figure 8D:
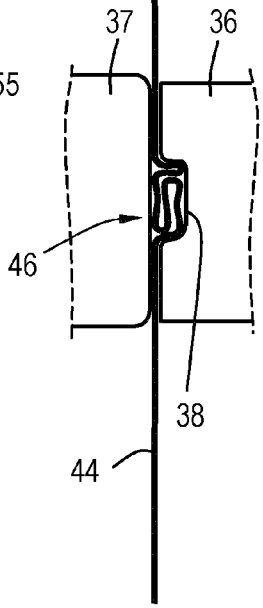

FIGS. 8A-D show a container body 44 comprising the bead 39 which is again extending inwardly of the container body. The container body 44 is subjected to radial expansion using an expansion tool 45. The situation after radial expansion of the section comprising a bead 39 is shown in FIG. 8C. The effect is that the now formed bead 46 extends radially outwardly on the outer surface of the container body 44.

Figure 9:
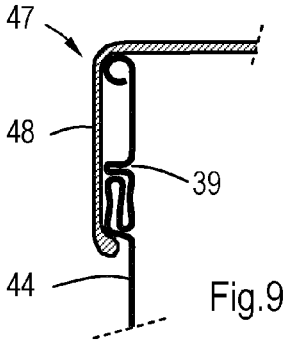
FIG. 9 shows the use of an outwardly extending kinked and compressed bead as a part of a snapping connection with a container cap.
Figures 11A, 11B, 11C, 11D:
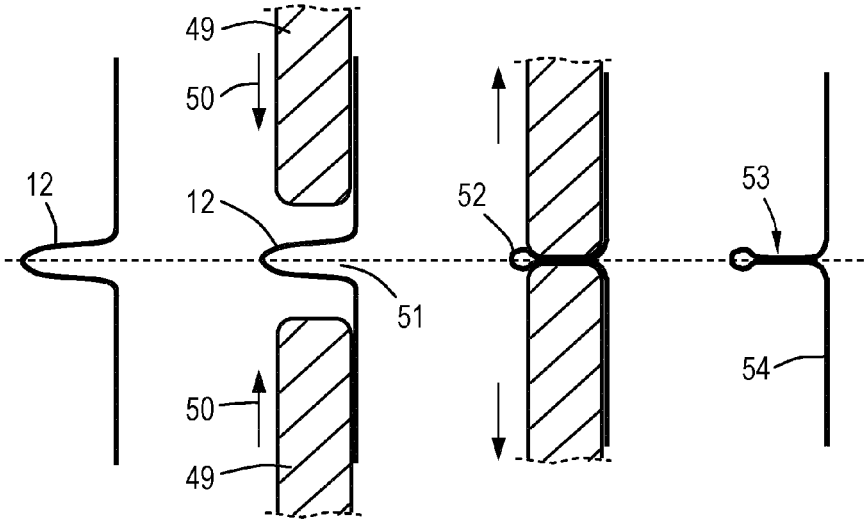
FIGS. 11A-D show an alternative manner for making a closed bead.

FIG. 9 shows the upper part of a container 47 comprising its upper section a radially outwardly extending bead 39. This bead 39 is used for mounting and connecting via a snapping connection a cap 48 onto the container body 44.

Figure 2:
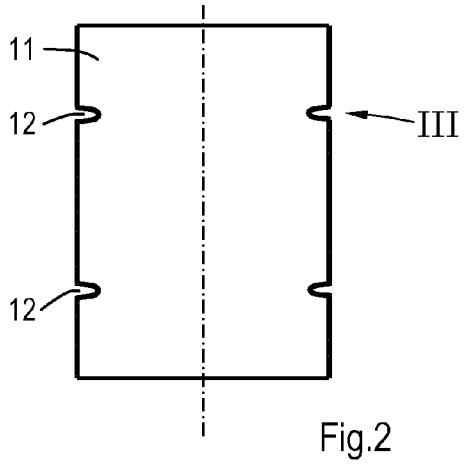
FIG. 2 shows a cross-section of a perform of a container according to the invention.
Figure 10:
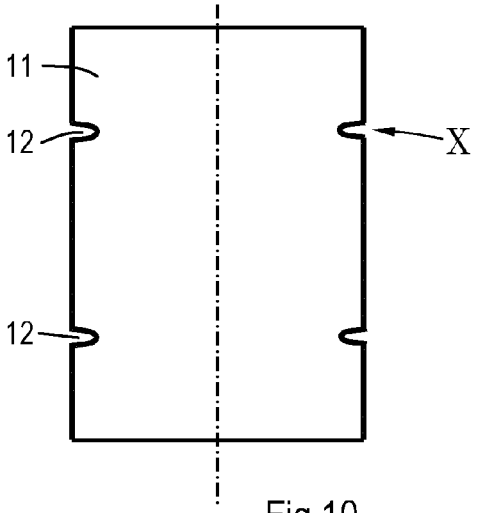
FIG. 10 shows the preform of FIG. 2.

FIG. 10 shows a cross-section of the same preform 11 as shown in FIG. 2 and comprising the bead 12. As shown in FIGS. 11A-D, this circumferential and symmetrical bead 12 is subjected to radial compression with the tools 49 moving in the direction of the arrows 50. This results in a closing of a gap 51 of the bead 12 allowing a proximal head like section 52 in the ultimate bead 53. Accordingly, it is avoided that particularly in the section 52 cracking would occur and thereby would be formed an open connection in between the inside of the container body or container 54 and the outside.

Figure 12A:
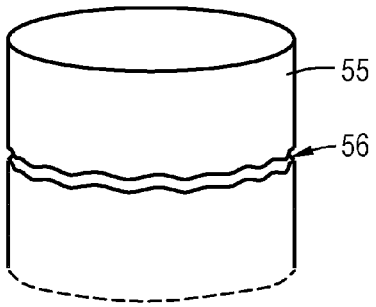
FIGS. 12A and 12B show a serpentining bead extending over the circumference in the open form (FIG. 12A) and in kinked form (FIG. 12B)
Figure 12B:
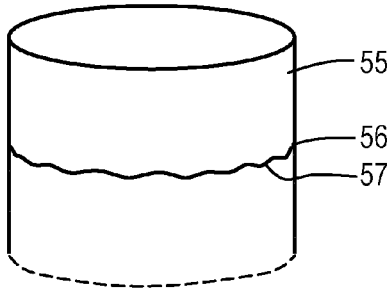

FIGS. 12A and 12B show a container body 55 comprising a bead 56 having a wavy structure. The wavy form may be harmonious or irregular as desired over the circumference. FIG. 12B shows the same container body 55, but the bead 56 is now in its kinked form whereby the bead 56 is closed. The result is a wavy line 57 extending over the circumference of the container body 55.

Figure 13A:
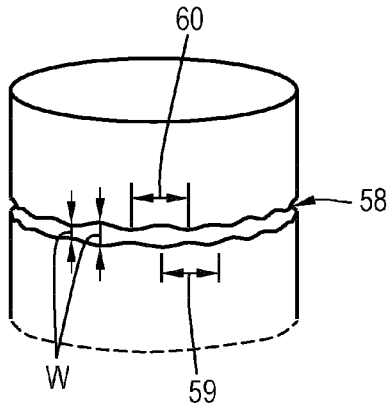
FIGS. 13A and 13B show a wavy bead with increasing and decreasing bead width in the open form (FIG. 13A) and in kinked form (FIG. 13B)
Figure 13B:
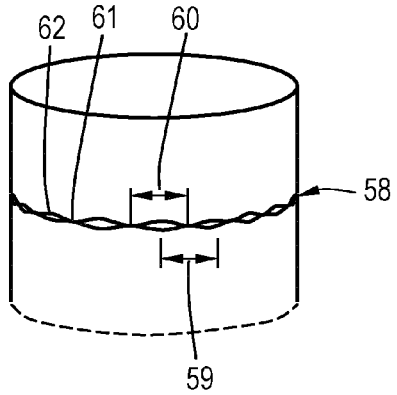

FIGS. 13A and 13B show an alternative bead 58 according to the invention which has a region 59 with a bead width W which is minimal and a region 60 with a bead width W which is maximal. Change in bead width W may be gradual but may also be abruptly, and non-harmonious. FIG. 13B shows, that in the region 59 the bead is closed and that the bead width W is nearly minimal or not present. In the region 60 the width of the bead 58 is now less than the bead width W of the section 60 in FIG. 13A. Accordingly, there is formed a bead 58 with bead parts 61 that are closed and bead parts 62 that still have an inwardly open structure. Both bead parts 61 and 62 may be repeating over the circumference in a regular or irregular manner.

Figure 14A:
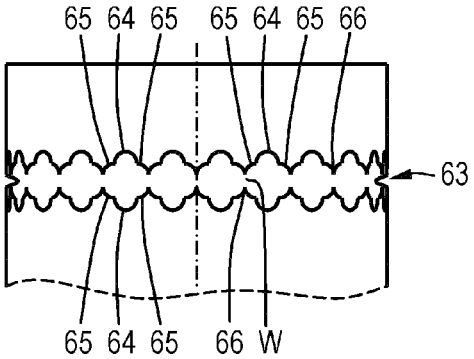
FIGS. 14A and 14B show an ornamental bead in the open form (FIG. 14A) and closed form (FIG. 14B) giving the impression of a four leaf clover.
Figure 14B:
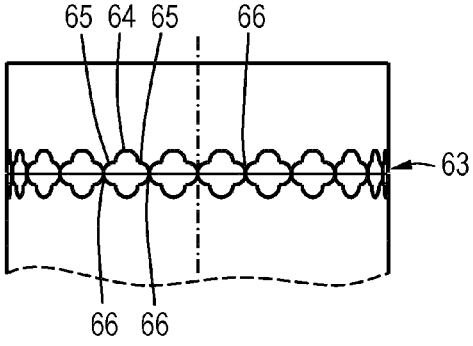

FIGS. 14A and 14B show an ornamental bead 63 according to the invention. The bead 63 is having the form of alternating lobes 64 in combination with adjacent smaller lobes 65 which are connected via a section 66 with smallest bead width W. After kinking the bead 63 is closed in the sections 66, the kinked bead 63 having a bend line, provides an impression of a row of four leave clovers.

Figure 15A:
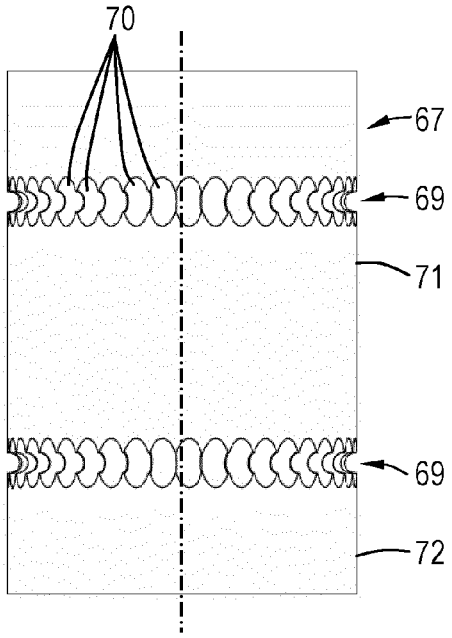
FIGS. 15A-15C show a bead in the form of neighbouring dimples formed after kinking and closing (FIG. 15B) the bead and extending inwardly, and FIG. 15C extending outwardly.
Figure 15B:
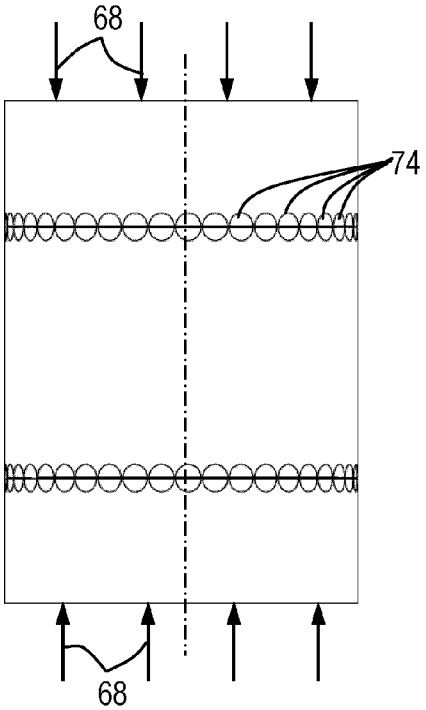
Figure 15C:
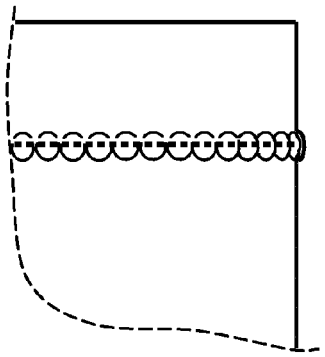

FIGS. 15A-15C show a container body 67 with an alternative bead 69 comprising a row of open dimples 70 formed in the upper section 71 and lower section 72 of the container body 67. After kinking according to the arrows 68 the bead 69 is formed into a row of dimples 74 which may extend inwardly and having a bend line (FIG. 15B) or outwardly (FIG. 15C) when the initial dimples 70 extend outwardly having in cross section the form of the bead of FIG. 3E. When extending outwardly the row of dimples 74 provides a sensation of a row of dimples. When extending inwardly the beads 74 provides the sensation of a row of indents.

Figure 16A:
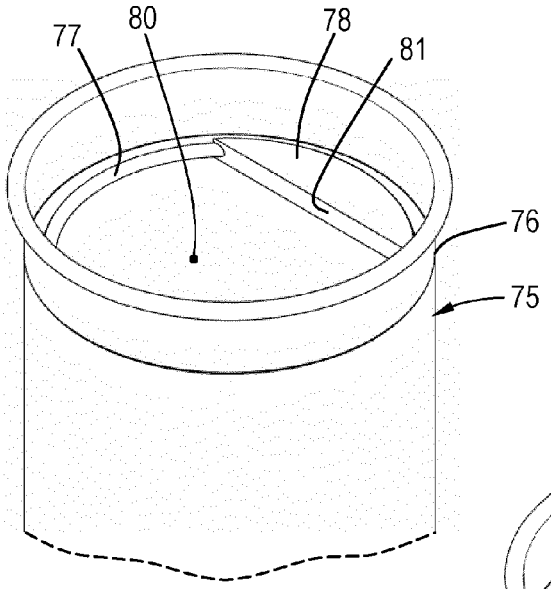
FIGS. 16A-16C show in perspective and cross sectional views the use of an insert connected to a kinked bead.
Figure 16B:
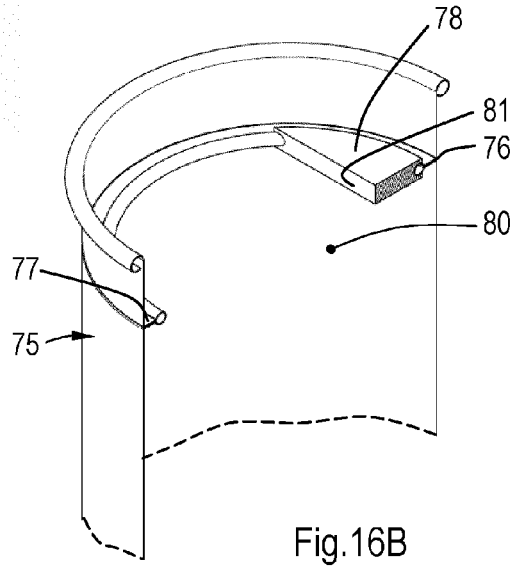
Figure 16C:
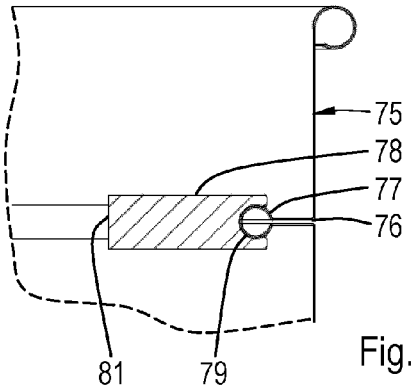

FIG. 16A show a container body 75 provided with a kinked and closed bead 76 with an inwardly extending free end 77 with in cross section a spherical form. A plastic insert 78 is having a cavity 79 which is complementary in cross section to the spherical form of the free end 77. The insert 78 extends over a part of the circumference of the free end 77 and covers a part of the opening 80 thereby forming a free edge 81 which can be used for metering material taking with a spoon from the interior of the can body 75, or stripping paint from a brush which was dipped into paint present in the container body 75.

Figure 17:
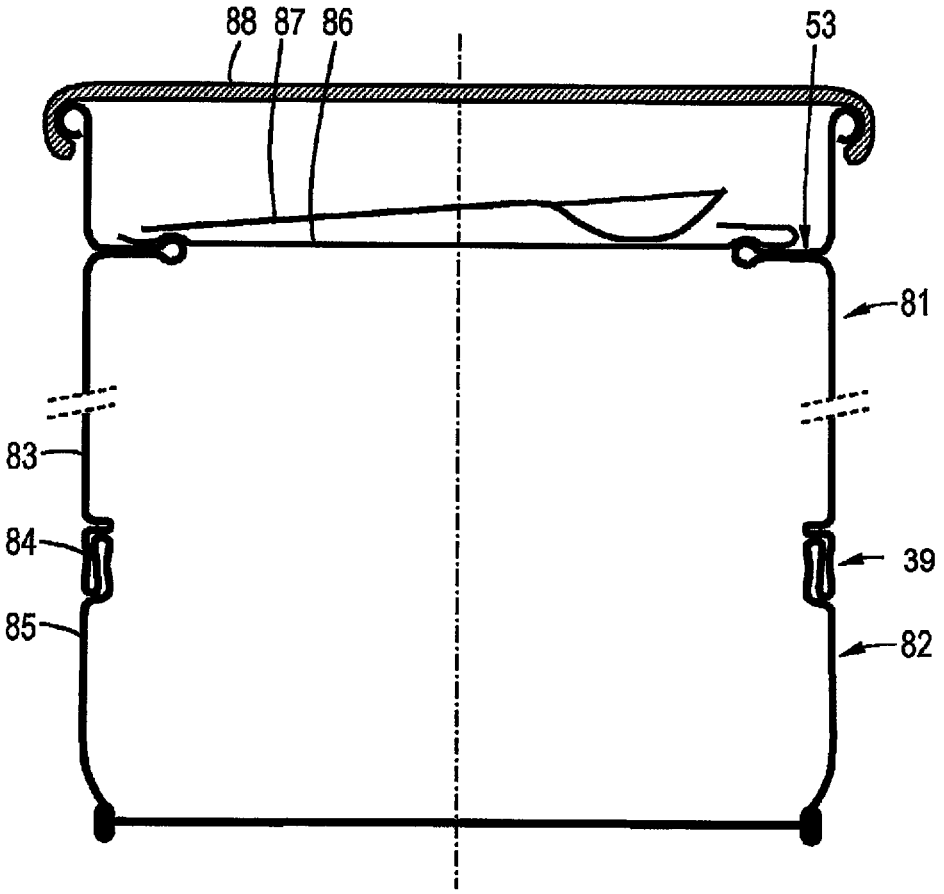
FIG. 17 shows a container comprising a container body of the invention being kinked and radially inwardly compressed.

Finally, FIG. 17 shows a container 81 comprising a container body 82. The container body is provided with a kinked and radially compressed bead 39 (as described in relation to FIGS. 7A to 7C) and a bead 53 (as described in relation to FIGS. 11A to 11D). The bead 39 is present for increasing the strength of the container body 82, but also for providing boundaries for different types of information printed in the sections 83, 84 and 85. The bead 53 also provides strength to the upper part of the container body and provides support for a foil 86 closing of the content of the container 81 and carries a metering spoon 87. The container 81 is closed by a cap 88.

The invention claimed is:

1. A method of making a container body, comprising the steps of:

i) providing a round container body;

ii) forming at least one circumferential bead in the container body;

iii) axially compressing the container body to kink and axially close the bead, thereby creating a kinked bead; and iv) radially compressing the kinked bead, thereby creating a radially compressed, kinked bead.

2. The method according to claim 1, wherein the bead has a symmetrical shape and in step iii) kinking is initiated at one side of the symmetrical bead.

3. The method according to claim 1, wherein the bead has an asymmetrical shape such that the kinking force is different at both bead sides.

4. The method according to claim 1, wherein the radially compressed, kinked bead is is caused to extend radially outwardly of an outer surface of the container body by radial expansion of the container body and is then radially compressed by a compression tool.

5. The method according to claim 1, wherein the kinked bead is radially inwardly compressed to create the radially compressed, kinked bead.

6. The method according to claim 1, further comprising the step of providing printed information on the container body, which printed information is separated from a container body section in which the circumferential bead is to be formed.

7. The method according to claim 1, wherein the bead has the form of a serpentining bead, a wavy bead, and/or an ornamental bead.

8. A container comprising a container body provided with at least one circumferential axially closed and kinked bead, wherein the kinked bead is radially compressed.

9. The container according to claim 8, wherein the bead extends radially outwardly or inwardly from the container body wall.

10. The container according to claim 8, further comprising printed information at both sides of the kinked bead.

11. A container body obtainable by the method according to claim 1.

12. The container according to claim 8, wherein the bead extends radially outwardly or inwardly from a container body wall of the container body.

13. The method according to claim 2, wherein the bead has an asymmetrical shape such that the kinking force is different at both bead sides.

14. The method according to claim 6, wherein the printed information is present at both sides of the closed and kinked bead and is provided in a flushing manner.

15. The container according to claim 10, wherein the printed information at both sides is printed in a flushing manner.

* * * * *